US005709294A

United States Patent [19]

McGough

[11] Patent Number: 5,709,294

[45] Date of Patent: Jan. 20, 1998

[54] NON-JAMMING COIN CHUTE TRIGGER ASSEMBLY FOR PAY TELEPHONES

[75] Inventor: Gerald B. McGough, Huntsville, Ala.

[73] Assignee: Quadrum Telecommunications, Inc., Huntsville, Ala.

[21] Appl. No.: 638,227

[22] Filed: Apr. 26, 1996

[51] Int. Cl.[6] ..... G07F 5/22

[52] U.S. Cl. ..... 194/230; 194/244; 200/DIG. 3

[58] Field of Search ..... 194/219–223, 194/230, 239, 242, 244; 200/DIG. 3

[56] References Cited

U.S. PATENT DOCUMENTS 3,696,905 10/1972 Tojza et al. ..... 194/221
3,699,259 10/1972 Main et al. .
3,878,928 4/1975 Albright ..... 194/219 X
3,941,226 3/1976 Drakes .
4,988,860 1/1991 Wollet et al. .
5,425,439 6/1995 Tsuchida .

FOREIGN PATENT DOCUMENTS 951990 7/1974 Canada ..... 194/244

*Primary Examiner*—F. J. Bartuska
*Attorney, Agent, or Firm*—Robert J. Black

[57] ABSTRACT

A coin chute trigger assembly having separate coin paths for nickels, dimes, and quarters. Intentionally, the dime coin path is made at least twice as wide as the thickness of a dime in order to prevent hangups and jams. A trigger included in each coin path is operated in response to deposit of the appropriate coin through the coin chute or path and causes operation of an included pair of switching contacts.

4 Claims, 1 Drawing Sheet

NON-JAMMING COIN CHUTE TRIGGER ASSEMBLY FOR PAY TELEPHONES

BACKGROUND OF THE INVENTION

1. Field of the Invention

The present invention relates to pay or coin telephones and more particularly to a coin chute trigger assembly which utilizes new chute geometry which effectively prevents dime coin jams as well as redesign to overcome many of the problems existing during manufacturing.

2. Background Art

A search of the background art directed to the subject matter of the present invention disclosed the following U.S. Patents:

| U.S. PAT. NO. | INVENTOR | ISSUE DATE |
|---|---|---|
| 3,699,259 | Main et al | October 1972 |
| 3,878,928 | Albright | April 1975 |
| 3,941,226 | Drakes | March 1976 |
| 4,988,860 | Wallet et al | January 1991 |
| 5,425,439 | Tsuchida | June 1995 |

Based on a thorough review of the above-identified patents, it is believed none of the above teach, disclose, or claim the novel combination of elements and functions found in the improved product taught by the present invention.

Main et al teach coin switch apparatus for prepay coin actuator mechanisms, such as telephones in which a minimum prepay amount must be deposited for actuation of the mechanism. The patent teaches the inclusion of a coin channel on the housing to find a first preferential path and a second alternative path with both paths terminating in common entry and exit positions, Albright is drawn to a one-piece extruded aluminum coin slot device including a plurality of parallel walls and housing for the operating parts of a vending machine. The coin slot device taught therein includes four walls connected to a housing with a first coin slot formed between first, second, third, and fourth walls, and coin supporting means connecting the housing to form a second coin slot.

Drakes is also drawn to a coin switch for a coin operated vending machine. After successfully passing a slug rejector, coins are dropped through a chute according to the denomination. Step means are included in each coin chute included within the coin switch, adapted for retarding the fall of coin therethrough to a controlled rate. Light beams pass across each of the chutes, Wallet et al teach a trigger switch for use in coin operated devices particularly pay telephones wherein a plurality of parallel channels each include one or more openings through which light beams pass to light detectors. Passage of coins through the included elements blocks transmission of light to operate associated trigger mechanisms.

Tsuchida describes a coin escalator for use in gaming machines for passing coins from a first location to a second location. An elongated coin escalator having a curved portion configured to allow passage of coins from the first location to the second location along a path plate including curved portion defining an outwardly projecting section to assist in avoiding jamming. The recess is included in the coin path with the width of the recess being smaller than the diameter of the passing coins.

It is noted that the present invention is suitable for use in pay telephones similar to those in current use and particularly for use in pay telephones manufactured by Quadrum Telecommunications. In such units in response to deposit of coins signals are transmitted to an associated telephone central office. Such signals may be utilized for establishing and energizing circuits for an associated coin relay. At the telephone central office, application of voltage of one polarity will cause coins to be collected, while application of voltage of an opposite polarity will cause coins to be returned via a refund chute if such refund is appropriate. Operation of the relay also serves to restore the coin trigger circuitry to normal.

Many different types of coin trigger devices have been employed for use in pay telephones or in other coin collecting machines. Such coin trigger devices employ various methods of identifying and counting coins. Existing mechanical coin chute trigger switches manufactured by Quadrum and others have been in their present configuration for almost twenty years. In such arrangements, essentially coins pass through a mechanism in three coin paths or rectangular tubes or coin chutes, one each for nickels, dimes, and quarters. As each coin traverses its path, it strikes and rotates a finger extension of a rotating switch actuator referred to as a trigger. Included on each trigger opposite the finger extension is a cam. This trigger cam, when rotated, operates an associated set of electrical contacts whereby in response to the switch contacts closure, separate electrical signals are generated for each type of coin deposited.

Each trigger assembly also includes a second finger which extends roughly 180° from the first and is utilized to strike a paddle or operating point of an associated coin relay mechanism which is not part of the present invention. This action occurs when an initial coin deposit is made. The paddle, in conjunction with a cam and switch, imparts a first coin signal and generates important data for use in processing a call.

Existing designs experience difficulty when a first dime fails to completely operate the included trigger within the dime path or chute. The reasons the first dime may be stopped may be obvious inasmuch as the dime has substantially less weight than coins such as a nickel or quarter. The jam may also be the result of a combination of resistor forces, such as trigger return spring tension, trigger release spring tension, relay paddle operate force, friction caused by dirt, wear, rough surfaces and/or misalignment.

In such instances, the deposit of a second dime with then frequently jam or wedge the first due to the funneling or narrowing of the coin chute path. Thus, further deposits of coins will be of no avail in clearing this type of jam. Dimes will continue to stack up and make clearing extremely difficult.

In the past, the coin chute trigger assembly included a chute structure consisting of two pieces which were glued together during construction. Because of the plastic involved in the construction, solvent glues were utilized in this process. These glues were determined to be of hazardous materials, undesirable for utilization in a manufacturing facility. Also, quality control problems were numerous in such arrangements because of the difficulty of alignment of the two sections of the chute. Accordingly, many units were frequently rejected during inspection.

SUMMARY OF THE INVENTION

The present invention consists of a one-piece plastic coin chute trigger assembly of unitary construction usually constructed of plastic including three parallel chutes. Each chute is rectangular in cross-section and includes a predetermined taper from top to bottom. A first chute is configured for receiving nickels, a second for dimes, and a third for quarters. Of particular importance is the width of the coin path or chute, particularly for the chute which receives the deposit of dimes therethrough. The width is determined so as to be greater than the thickness of two dimes in order to prevent jams.

Positioned adjacent to each chute is a spring loaded rotating trigger each of which includes a first finger protruding into the adjacent coin path. Each trigger also includes a cam mounted thereon as well as a second finger which extends out in an opposite direction from that of the first finger. At the bottom of each coin path or chute, the opening from the chute is extended in a forward direction so as to function as a trigger guide for the associated trigger. The first finger of each trigger is angled so as to prevent being trapped in the operated position by a coin passing through the coin path.

Attached to the coin chute trigger assembly are a number of switch contacts with a single pair of contacts being associated with each trigger and associated coin path. During operation, when a coin passes through the coin path, the included trigger is rotated about its axis and the cam located thereon engages the associated pair of switch contacts to provide closure, establishing a circuit connection for signals transmitting to the telephone central office.

During normal operation, coins pass through the three coin paths for the nickel, dime, and quarter. As each coin traverses the path, it strikes the finger extension of the associated trigger causing rotation. On each trigger, opposite the first finger extension is a cam. The trigger cam, when rotated, operates an associated set of electrical switch contacts as indicated. Separate electrical signals are thereby generated for each type of coin deposited for extension to the telephone central office.

The second finger extending from each trigger roughly at 180° from the first strikes a paddle of a coin relay mechanism as any first coin is deposited. This paddle, in conjunction with cam and switch, imparts a first coin signal to the telephone central office which is utilized in processing the call.

In the case of prior art designs, the first dime deposited frequently fails to completely operate the dime trigger, being stopped in the dime coin chute and as a result, additional dimes deposited then wedge against it, causing a jam. As indicated, the reasons for the first dime stopping include a combination of resistive forces, such as trigger return spring tension, trigger release spring tension, relay paddle operate force, friction caused by dirt, wear, or rough surfaces, and/or misalignment. The second dime will then frequently jam or wedge into the first due to the funneling or narrowing of the rectangular chute. As a consequence, further deposit of coins are of no avail for clearing this type of jam. Additional dimes then stack up and make clearing extremely difficult.

In the coin chute of the present invention, the dime chute has been made wider than previous designs. The new width is such as to allow two dimes to travel side by side down the rectangular chute. Therefore, should the first dime not pass through the chute, the second dime would not be wedged, but rather would add sufficient weight to operate the trigger under even the most adverse of circumstances.

As indicated, the improved design presented herein includes a single one-piece mode of construction avoiding the problems associated with the previous two-piece glued construction. It was also determined because of the widening of the coin paths it was necessary to widen the trigger to match the wider dime chute. This prevented dimes from wedging alongside the trigger. Inasmuch as the same trigger is utilized for nickel, dime, and quarter chutes, respective chutes also need matching to the new trigger width. Thus, it was found practical to make the widths of each of the coin paths at least as wide as the thickness of two dimes.

Configuration of the finger actuator had to be adjusted in order to address the possibility of return hangups. Such problem being created by the redesign of the chute into one-piece construction. Essentially, the trigger must be prevented from moving sideways during rotation and becoming trapped under any projecting finger or ledge in the chute. A critical area for this exists when the finger actuator rotates beyond the first vertical rib to be picked up by the trigger guide feature. This particular feature prevents hangup of the trigger by extending its tip at an angle. Such changes do not affect other performance characteristics of the mechanism. Merely extending the trigger finger would prevent hangups but would change the trigger signal output.

BRIEF DESCRIPTION OF THE DRAWINGS

A better understanding of the present invention may be had from consideration of the following detailed description taken in conjunction with the following drawings.

DESCRIPTION OF THE PREFERRED EMBODIMENTS

Referring now to FIGS. 1, 2, 3, and 4 of the accompanying drawings in which similar numbers refer to the same part in the various views shown.

Figure 1:
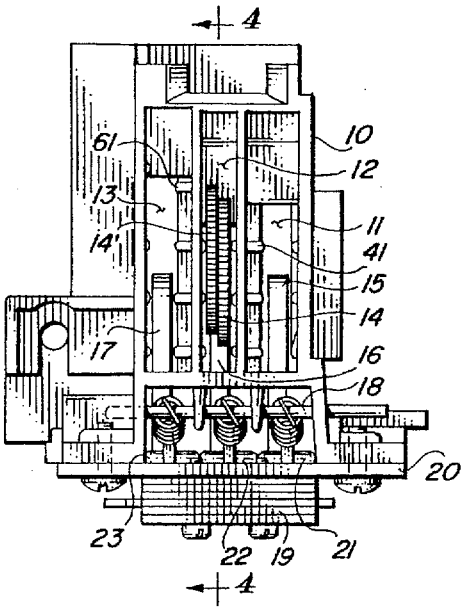
FIG. 1 is a top view of a coin chute trigger assembly in accordance with the present invention.
Figure 2:
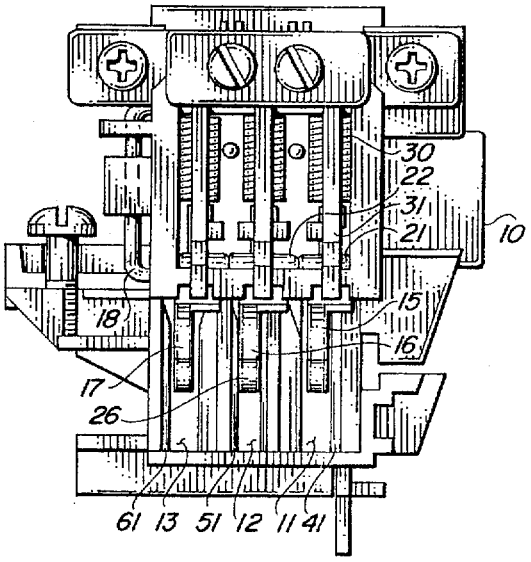
FIG. 2 is a front view of the trigger switch for use in pay telephones in accordance with the present invention.
Figure 3:
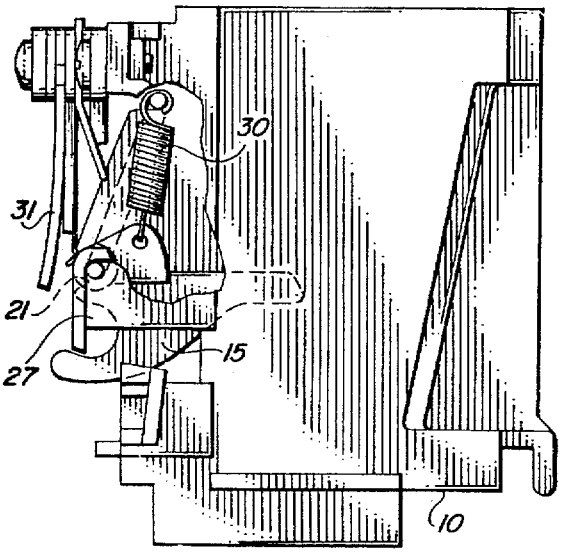
FIG. 3 is a left side view of a coin chute trigger assembly in accordance with the present invention.
Figure 4:
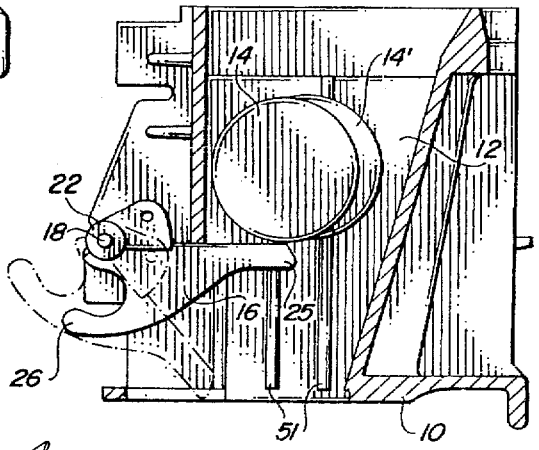
FIG. 4 is a sectional view of a coin chute trigger assembly taken along lines 4—4 of FIG. 1.

The present invention employs a one-piece coin chute trigger assembly 10 of unitary construction of clear transparent plastic. Included in the assembly are three parallel chutes numbered 11, 12, and 13, respectively. Chute 11 is intended to receive nickels, chute 12 dimes, and chute 13 quarters. As can be seen in FIGS. 3 and 4, the chutes are tapered from top to bottom, being wider at the top portion and narrower at the bottom. As can be seen in FIG. 1 and sectional FIG. 4, as taken along the lines AA of FIG. 1, each of the chutes includes a plurality of ribs, such as 41, 51, 61, etc. These ribs ensure that coins will be guided in a general direction through the chute while providing only minimal friction against the moving coins as they pass through the respective chutes.

Of particular importance in the present invention is the width of the coin path or chute 12 through which dimes pass. The width of this slot is determined to be greater than the thickness of two dimes in order to prevent jams. As can be seen in FIG. 1, it is possible for two dimes 14 and 14' to pass side by side through chute 12.

As sometimes happens when a first dime 14 is dropped down chute 12, this first dime may be stopped for a number of reasons due to the fact that dimes carry minimum weight as compared to nickels or quarters. A number of resistive forces, such as trigger return spring 30, tension on trigger 16, an associated relay paddle operate force, friction that may be caused by dirt, wear, or rough surfaces all may enter into the possibility of dimes, such as 14', wedging along dime 14. Should chute 12 be narrow enough to only accept one dime, as has been the case in the prior art, it would be obvious that a jam could occur with the resultant difficulty in removing the jam without the attention of a service man.

Positioned adjacent to each chute is a spring loaded rotating trigger, such as 15, 16, and 17, respectively, associated with chutes 11, 12, and 13. Each of these triggers rotate about an axle or pin 18, as may be seen in sectional FIG. 4. Each trigger (for example, trigger 16) includes a first finger, such as 25, which includes an angled tip to prevent it being trapped in the transition area as it rotates about pin 18. Each trigger also includes a cam 22 and a second finger, such as 26. As can be seen in FIG. 4, at the bottom of each coin path or chute, the opening of the chute is extended in a forward direction so as to function as a trigger guide, such as 27, for the associated trigger. As indicated, finger 25 of each trigger is angled so as to prevent being trapped in the operated position by a coin passing through the coin path or chute.

Attached to the coin chute trigger assembly are a number of switch contacts, such as 31, as a coin is passed through the chute and the associated trigger is rotated, as may be seen in FIG. 3, trigger 15 rotates and cam 21 then engages spring 31 causing it to operate. When the associated pair of switching contacts, such as 31, operate, this provides closure establishing a circuit connection for signals to be transmitted to the telephone central office via circuitry (not shown).

During normal operation, coins passing through the coin paths 11, 12, and 13, for nickels, dimes, and quarters, respectively, strike the finger extension of the included trigger, such as 15, 16, and 17, respectively, causing the cam included on the trigger to operate the associated set of electrical switch contacts. Thus, separate electrical signals are generated for each type of coin deposited for extension to the telephone central office as is indicated.

The second finger, such as 26, extending from each trigger roughly at 180° from the first trigger, such as 25, is utilized to strike the paddle of an associated coin relay mechanism (not shown) whereby in conjunction with the cam and switch operation a first coin signal is transmitted to the telephone central office to be utilized in processing the call.

Many prior art designs fail to completely operate the dime trigger causing the dime to be wedged in the dime chute or coin chute. The dropping of additional dimes deposited in the dime chute then wedge against the first dime causing a jam. As indicated above, the reasons for the first dime stopping include a combination of resistive forces. A second dime would then wedge against the first due to funneling or narrowing of the chute, so the deposit of additional dimes would be to no avail since they would merely stack up and require the attention of a service man to clear the resulting jam.

As indicated in the present invention, the dime chute has been widened over previous designs, with the new design able to allow two dimes to travel side by side, such as 14 and 14', down rectangular coin chute 12. Accordingly, should the first dime not pass through the chute, the second dime would not be wedged, but rather would have sufficient weight to then operate the trigger under even the most adverse of circumstances. The one-piece unitary plastic housing 10 avoids many of the problems associated with the previous two-piece glued construction.

It should also be noted that because of the widening of the coin chutes, it was also necessary to widen the triggers, such as 15, 16, and 17, to prevent coins from wedging alongside the trigger. This was particularly true for the dime chute 12 and trigger 16 included therein. Inasmuch as common triggers are utilized for all three chutes, it is necessary to make the nickel and quarter chutes, 11 and 13, respectively, at least as wide as the thickness of two dimes similar in width to that of chute 12, i.e., the dime chute or path. The design of the triggers, such as 15, 16, and 17, had to be adjusted in order to address the possibility of return hangups. Essentially, the trigger must be prevented from moving sideways during rotation about axle 18 to prevent it from being trapped under any projecting finger or ledge within the chute. Hangup is prevented by the design of the angled tip 25 of trigger 16 as well as the other triggers associated with the coin chutes 11 and 13. Such change does not affect the performance characteristics of the mechanism. It should be noted that merely extending the trigger finger without the angled tip would prevent hangup but would change the total trigger signal output.

While but a single embodiment of the present invention has been shown, it will be obvious to those skilled in the art that numerous modifications may be made without departing from the spirit of the present invention, which shall be limited only by the scope of the claims appended hereto.

What is claimed is:

1. For use in a coin telephone, including a coin relay, a non-jamming coin chute trigger assembly comprising:

a one-piece coin chute assembly of unitary construction including a first coin path adapted to pass nickels;

a second coin path adapted to pass dimes;

a third coin path adapted to pass quarters;

at least one of said coin paths including a width dimension equal to at least twice the thickness of the coins which it is adapted to pass;

a pair of switching contacts adjacent to each of said coin paths;

first, second, and third rotating triggers, each positioned adjacent to a different one of said coin paths and each including a cam, and a first finger extending into the adjacent coin path operated in response to a coin passing through said adjacent coin path to rotate said trigger;

said cam in response to said rotation of said trigger effective to operate one of said pairs of switching contacts;

each of said triggers further including a second finger operated in response to rotation of said trigger to operate said coin relay.

2. A coin chute trigger assembly as claimed in claim 1 wherein:

said coin chute assembly is of one-piece unitary construction.

3. A coin chute trigger assembly as claimed in claim 2 wherein:

said coin chute assembly is constructed of plastic.

4. A coin chute trigger assembly as claimed in claim 1 wherein:

each of said triggers further includes a second portion adapted in response to operation of said trigger, to operate said coin relay.

* * * * *